United States Patent [19]

Wilcox et al.

[11] Patent Number: 4,487,328

[45] Date of Patent: Dec. 11, 1984

[54] CONTAINER CASE

[75] Inventors: Donald G. Wilcox, Seymour; Nobile Zambrano, Branford, both of Conn.

[73] Assignee: Show-Pak, Incorporated, New Haven, Conn.

[21] Appl. No.: 437,640

[22] Filed: Oct. 29, 1982

[51] Int. Cl.[3] ..... B65D 43/14; B65D 51/04

[52] U.S. Cl. ..... 220/241; 220/334; 220/72; 220/70; 220/74; 220/254; 220/94 A

[58] Field of Search ..... 220/241, 242, 334, 72, 220/70, 74, 254, 94 A

[56] References Cited

U.S. PATENT DOCUMENTS

| | | | |
|---|---|---|---|
| 2,346,636 | 4/1944 | Porter | 220/254 |
| 2,765,948 | 10/1956 | Paley et al. | 220/254 |
| 2,883,853 | 4/1959 | Forni | 220/254 |
| 3,207,359 | 9/1965 | Heisler et al. | 220/94 A |
| 3,831,805 | 8/1974 | Yonce | 220/94 A |
| 3,872,996 | 3/1975 | Dogliotti | 220/254 |

FOREIGN PATENT DOCUMENTS 295736 4/1932 Italy .

*Primary Examiner*—Joseph Man-Fu Moy
*Attorney, Agent, or Firm*—Curtis, Morris & Safford

[57] ABSTRACT

A blow molded container case has a main body portion, a lid and a lid hinge which pivotally mounts the lid to the main body portion. The main body portion includes top and bottom walls and side walls interposed between the top and bottom walls and interconnected thereto at corresponding peripheral edge portions thereof. The top wall has formed therein an opening for access to the interior of the main body portion. The opening is spaced inwardly from the periphery of the top wall. A portion of the top wall surrounding the opening is shaped to form a well to closely receive the lid. The lid receiving well includes an inner wall projecting downwardly from the top wall of the main body portion, a seat portion projecting inwardly from the inner wall and a rim extending downwardly from the seat portion. The seat portion is recessed below the upper surface of the top wall a distance which corresponds substantially to the thickness of the lid so that, when the lid is properly seated in the receiving well in a closed position, the outer surface of the lid lies substantially flush with the upper surface of the top wall. The lid hinge includes a pair of pin posts which respectively project outwardly from opposite sides of the lid and are positioned near adjacent corners of the lid. The posts are received by cooperating holes formed in corresponding portions of the lid receiving well.

13 Claims, 3 Drawing Figures

CONTAINER CASE

BACKGROUND OF THE INVENTION

Field of The Invention

The present invention relates to a new and useful container case and more particularly to a blow molded or injection molded carrying case.

Many types of container cases serve not only to transport their contents in a safe and reliable manner but also to store such contents neatly and conveniently. A large number of these container cases are constructed from a synthetic material, such as plastic, which provides the case with strength and durability and a relatively light weight. Such container cases are particularly well suited for use by children for storage of toys, especially those toys which contain a number of individual components, for example, toy building blocks or the like.

Reference is made to U.S. Pat. No. 4,340,139 issued to Wilcox et al. as an example of such a container case. As described in the above reference, a blow molded carrying case has a base and a cover which are connected together on a corresponding side of each by an interrupted hinge. Such cases are lightweight to carry and yet durable and are perfectly adaptable for use by children.

One of the problems with such cases having a cover and a base, especially those having a cover and a base which are approximately equal in height, is that the maximum storage space for their contents is limited to the height of the base. If the case is filled beyond the height of the base, it is possible that such contents will spill out when the case is opened, even if the case is properly resting on its base.

OBJECTS AND SUMMARY OF THE INVENTION

An object of the present invention is to provide a new and useful container case which provides maximum storage area for its contents relative to the overall dimensions of the case.

A further object of the present invention is to provide a blow molded carrying case which is lightweight to carry and yet durable in construction, thus being particularly well suited for use by children.

Yet another object of the present invention is to provide a container case which has no sharp edges and is made from a non-toxic material, thus further enhancing its adaptability for use by children.

A still further object of the present invention is to provide a blow molded container case which is readily assembled and inexpensively manufactured.

The container case of the present invention basically comprises relatively flat, parallel top and bottom walls, interconnecting peripheral side walls and a hinged lid which is pivotally mounted to the top wall of the case and covers an opening formed in the top wall for access to the interior of the case. The access opening is formed by removing a portion of the top wall spaced inwardly from the side walls. The remaining portion of the top wall surrounding the opening is shaped to form a receiving well for the hinged lid. The receiving well includes a seat portion which is recessed below the upper surface of the top wall of the case a distance which corresponds to the thickness of the lid so that, when the lid is properly seated in the receiving well in thus a closed position, the outer surface of the lid lies flush with the upper surface of the top wall. The lid hinge includes a pair of pin posts which respectively project outwardly from opposite sides of the lid and are positioned near adjacent corners of the lid. The posts are received by cooperating holes formed in corresponding portions of the lid receiving well. The holes function to retain the lid to the case while allowing the lid to pivot about a lid edge axis between an open and a closed position. The bottom, top and side walls of the case are preferably formed of one-piece, single-walled blow molded construction and the lid of the case is preferably formed of one-piece, double-walled blow molded construction.

The above and other objects, features and advantages of this invention will be apparent in the following detailed description of an illustrative embodiment thereof, which is to be read in connection with the accompanying drawings.

DETAILED DESCRIPTION OF THE PREFERRED EMBODIMENT

Figure 1:
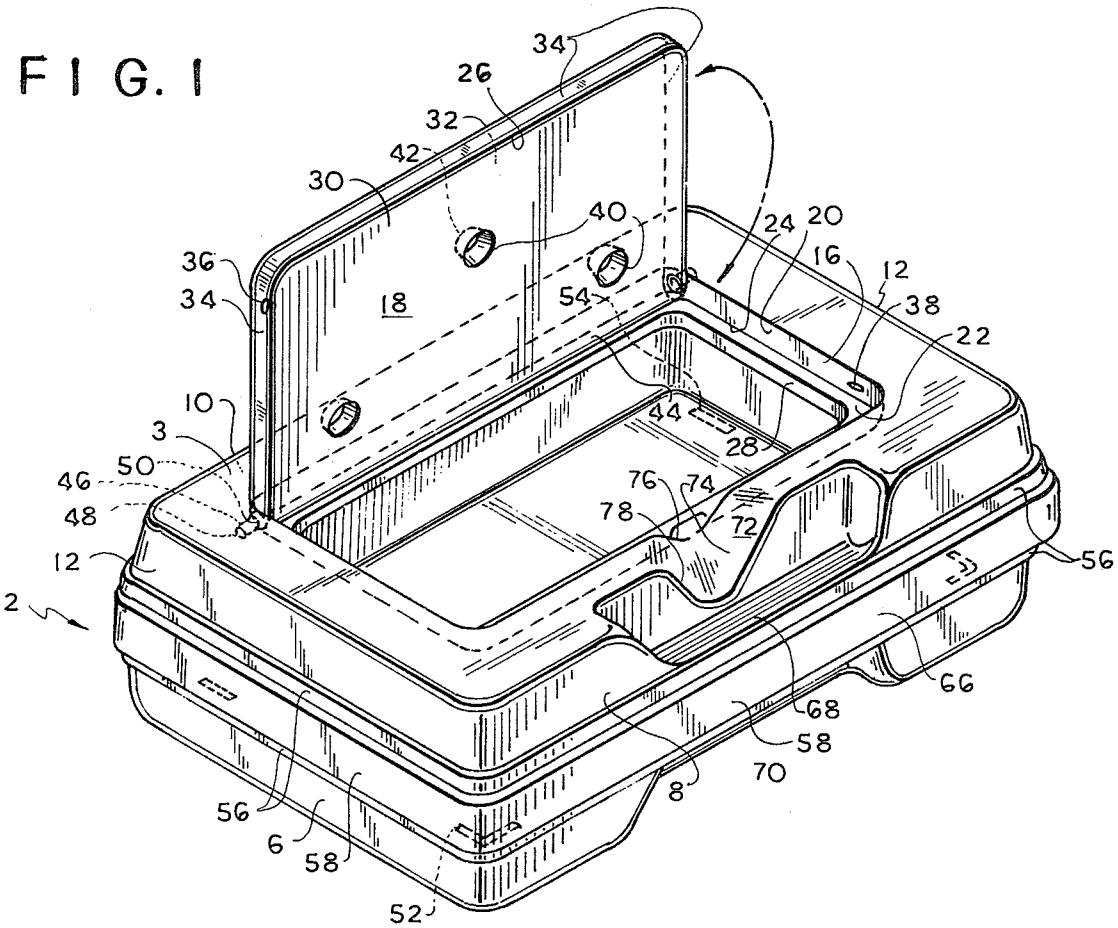
FIG. 1 is a perspective view of a container case constructed in accordance with the present invention.
Figure 2:
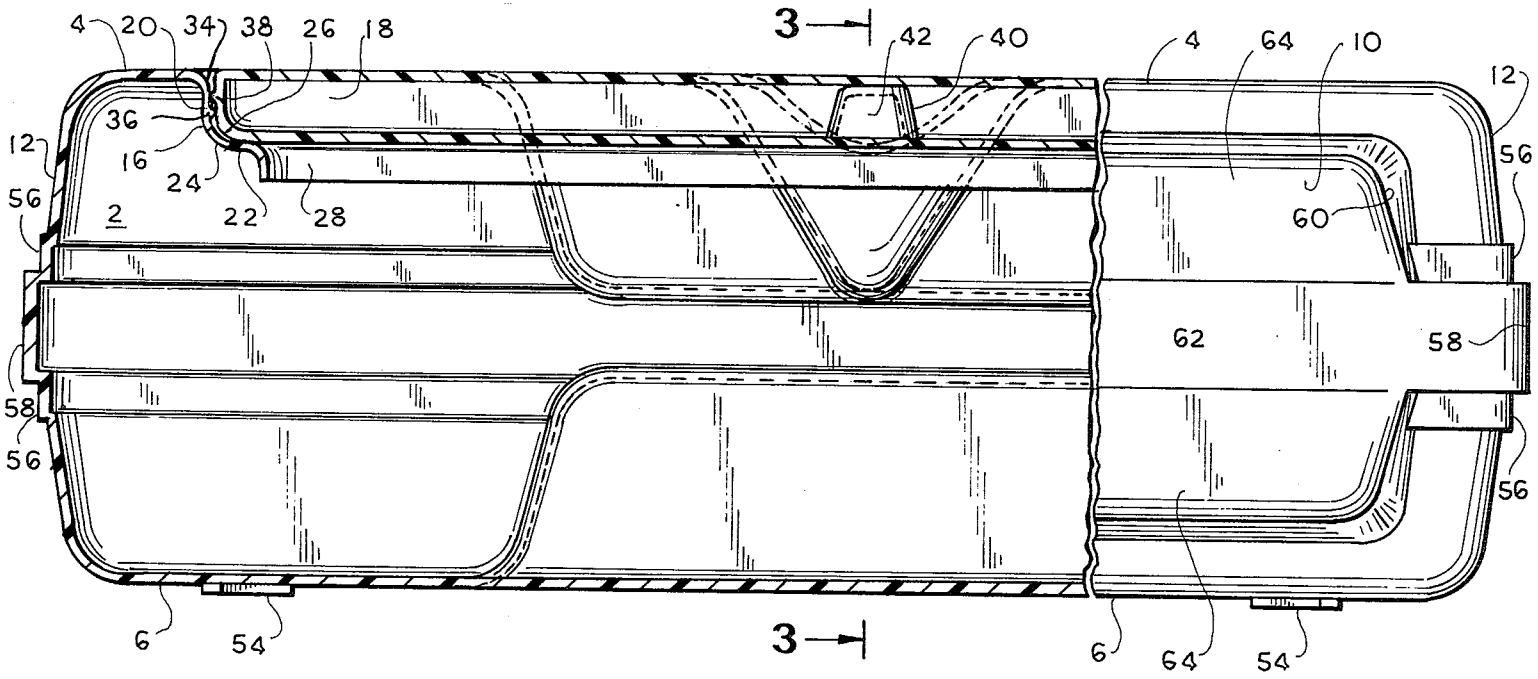
FIG. 2 is a rear elevation of the container case partially broken away.
Figure 3:
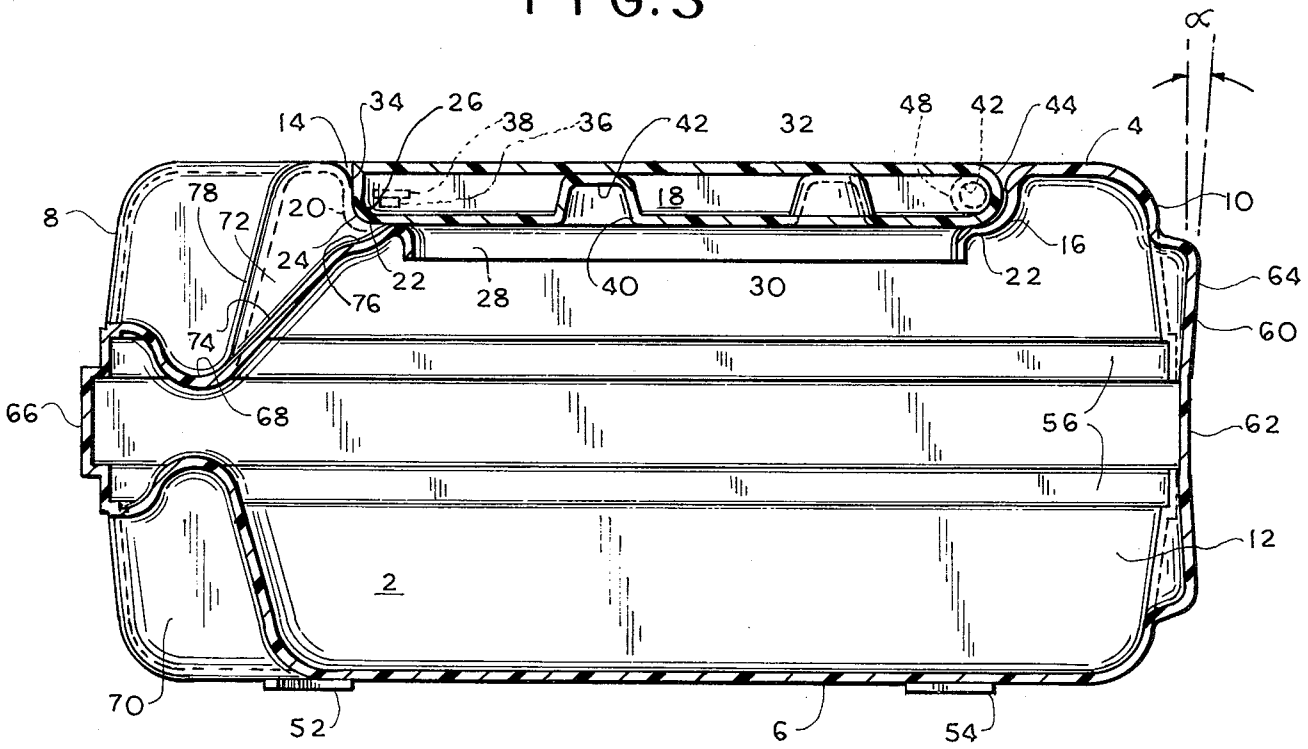
FIG. 3 is a transverse sectional view of the container case taken along lines 3—3 of FIG. 2.

Referring now to the drawings in detail and to FIGS. 1–3 thereof, it will be seen that a container case, constructed in accordance with the present invention, has a main body portion 2 which includes preferably flat top and bottom walls 4, 6 and interconnecting side walls which, for purposes of clarity, can be defined as including front wall 8, rear wall 10 and opposite lateral walls 12. The front and rear walls 8, 10 and opposite lateral walls 12 join the top wall 4 and bottom wall 6 at their respective peripheral edges. The top and bottom walls 4, 6 are for the most part parallel. The front wall 8 and opposite lateral walls 12 and a portion of the rear wall 10 are basically perpendicular to the bottom and top walls. The main body portion 2 of the container case which comprises the aforementioned walls is formed of a one-piece, blow molded construction and is single-walled in thickness. The main body portion 2 may also be formed by injection molding or the like and may comprise one or more pieces.

A portion of the top wall 4 spaced inwardly from the rear wall 10, front wall 8 and the opposite lateral walls 12 is removed to form an opening 14 for access to the interior of the case. A portion of the top wall which remains and which surrounds the opening 14 is shaped to form a receiving well 16 for a hinged lid 18 which is pivotally mounted to the top wall 4 and positioned to cover the access opening 14. The hinged lid 18 will be described in detail later.

The lid receiving well 16 includes an inner wall 20 which extends downwardly from the top wall 4. The lid receiving well further includes a seat portion 22 which is co-planar to the top wall and is formed as an inwardly projecting extension of the lowermost portion of the inner wall 20. The inner wall/seat portion juncture 24 is shaped to conform to the inner peripheral edge 26 of the hinged lid 18, shown in FIG. 2 to be rounded. The seat portion 22 is recessed below the upper surface of the top wall 4 a distance which corresponds to the thickness of the lid 18 so that, when the lid is properly seated in the receiving well 16 in thus a closed position, the outer surface of the lid lies flush with the upper surface of the top wall.

The seat portion 22 acts to prevent the lid from being pushed into the interior of the case beyond that which is intended. Depending upon the width of the seat portion 22, it is possible that the lid receiving well 16 will deform if excessive pressure is applied to close the lid. This may result in jamming the lid and permanently damaging the container case. To insure against this, the receiving well 16 may include a rim 28 in the form of a downwardly projecting and preferably inwardly sloped extension of the seat portion 22. Such a rim 28 will greatly strengthen the lid receiving well and prevent its deformation.

Because the top wall 4 is formed of one-piece, blow molded construction, it is desired that the receiving well, which includes the inner wall 20, seat portion 22 and downwardly projecting rim 28, be merely a continuation of the top wall and thus be also formed of one-piece construction.

As previously mentioned, the container case according to the present invention includes a hinged lid 18 which is pivotally mounted to the top wall 4 of the main body portion 2. The hinged lid 18 is also a one-piece unit formed by blow molding but is preferably double-walled in construction. The lid 18 may be constructed by injection molding or the like and may comprise one or more pieces joined together. The inner wall 30 of the lid is co-planar with the outer wall 32. Lid side walls 34 are approximately equal in height to the inner wall 20 of the receiving well, as is apparent from the earlier description. The inner peripheral edge 26 of the lid formed by the side walls 34 and the inner wall 30 of the lid is preferably rounded.

The hinged lid 18 further includes a pair of ribs 36 which respectively protrude from the surfaces of two opposite side walls 34 thereof. These cooperate with ribs or protrusions 38 formed on corresponding inner walls 20 of the lid receiving well 16. The ribs 36, 38 should protrude from their respective surfaces only so far as to allow each rib 36 of the lid to contact and pass a cooperating rib 38 of the receiving well when the lid is opened or closed. Thus the ribs 36, 38 form locking means to keep the lid in a closed position.

Because of the double-walled construction of the lid, the inner and outer walls 30, 32 of the lid are preferably joined at predetermined locations for strengthening purposes. This is accomplished by forming a series of recesses or wells 40 in the lid's inner wall 30 so that the bottom 42 of each well 40, which is the recessed portion of the lid's inner wall, abutts or, by annealing, fuses with the outer wall 32 of the lid and, accordingly, helps support the outer wall. Such a construction adds considerable strength to the lid. Of course, the lid strengthening wells 40 may be formed in any shape desired including the truncated conical shape shown in FIG. 2.

The rear edge 44 of the lid (i.e., the pivotal edge) is preferably semi-circular in shape to allow the lid to be opened or closed without binding with a corresponding inner wall 20 and seat portion 22 of the receiving well.

The container case according to the present invention also has a lid hinge 46 for pivotally mounting the lid 18 to the top wall 4 of the main body portion 2. The lid hinge 46 includes a pair of pin posts 48 which respectively project outwardly from opposite side walls 34 of the lid and are positioned near adjacent corners of the lid. These posts 48 are received by cooperating holes 50 formed in corresponding portions of inner wall 20 of the receiving well which act to retain the lid to the case while allowing the lid to pivot about a lid edge axis between an open and a closed position.

The bottom wall 6 of the container case may include front and rear support legs 52, 54 which support the case when placed on its bottom wall. The support legs 52, 54 are preferably projections extending downwardly from the outer surface of the bottom wall 6. Of course, these support legs 54 can be of any shape. Preferably, each of the rear support legs 54 is shaped as a single bar segment extending parallel to the lateral walls 12 of the main body portion 2 and each of the front support legs 52 is shaped as a pair of bar segments joined perpendicularly end-to-end. such a leg configuration may be used as a locator for positioning adjacent articles or merchandise. Each of the front and rear support legs 52, 54 is positioned inwardly from a corresponding corner of the bottom wall.

As previously mentioned, the front wall 8 and opposite lateral walls 12 of the main body portion extend, for the most part, perpendicularly between the top and bottom walls 4, 6. These walls may include inwardly stepped portions 56 formed above and below central portions 58 thereof. Such stepped portions 56 act to strengthen the side walls and thus provide a more durable container case.

The rear wall 10 of the main body portion is preferably shaped to form a supporting base 60 to allow the case to stand in an upright position. This supporting base 60 includes a central portion 62, which is perpendicular to the top and bottom walls 4, 6, and mutually diverging end portions 64 extending from the central portion 62. The end portions 64 assist in further stabilizing the case when the case rests on the rear wall. The end portions 64 preferably form an angle $\alpha$ with the plane in which the central portion 62 lies of about 0 to 20 degrees and optimally form an angle of about 3 degrees, although an angle of as much as 90 degrees will still provide stability to the case.

The container case is also provided with a carrying handle 66 formed integrally with the main body portion 2 on the front wall 8 thereof. The handle 66 is defined by upper and lower recesses 68, 70 formed in the top and bottom walls 4, 6 respectively and portions of the front wall above and below the stepped portions 56 thereof. The recesses 68, 70 are positioned centrally between the opposite lateral walls 12.

The container case also includes a thumb opening 72 which allows access to the inner peripheral edge 26 of the lid when the lid is in the closed position. The thumb opening 72 is formed as a V-shaped recess 74 in a portion of the top wall 4 between the lid receiving well 16 and the upper recess 68 defining the handle 66. The recess 74 extends at its inner periphery 76 below the level at which the seat portion 22 of the receiving well lies and extends at its outer periphery 78 to approximately the depth of the upper recess 68 defining the handle. From a human engineering standpoint such a configuration takes into account the angle of the thumb when an attempt is made to open the case. Thus, the recess 74 leaves a portion of the lid's inner peripheral edge 26 exposed and allows the case to be easily opened with thumb pressure.

The container case described above is a high volume storage container which is readily assembled and relatively inexpensive to manufacture. The design of the case according to the present invention allows one to use the full capacity of the case for transport and storage without spilling its contents when the hinged lid is opened. It is also made simple to operate and can be opened with thumb pressure. The locking means provided will insure that the lid will not inadvertently open when the case is being transported under normal conditions.

The container case according to the present invention meets all the requirements set forth in the Child Safety Act. The case is designed to be durable and to withstand severe treatment under reasonable use and abuse. All exposed corners and edges can be rounded to prevent accidental injury to children, who are anticipated to be the primary users of such cases. The rounded edges not only function as a safety measure but also provide the case with an aesthetically pleasing appearance. The container case may be readily manufactured by a blow molding process and can be formed of a non-toxic material which further enhances its adaptability for use by children. In addition, the walls and lid of the case can be formed with an aesthetically pleasing textured surface.

Although an illustrative embodiment of the invention has been described herein with reference to the accompanying drawings, it is to be understood that the invention is not limited to that precise embodiment, and that various other changes and modifications may be effected therein by one skilled in the art without departing from the scope or spirit of this invention.

What is claimed is:

1. A container case formed by a blow molding process which comprises a one-piece blow molded main body portion, a separate one-piece blow molded lid and hinge means for pivotally mounting said lid to said main body portion, said main body portion including top and bottom walls and side walls interposed between said top and bottom walls and interconnected thereto at corresponding peripheral edge portions thereof, said top wall having formed therein an opening for access to the interior of said main body portion, said opening being spaced inwardly from the periphery of said top wall, a portion of said top wall surrounding said opening being shaped to form a well to closely receive said lid, said lid receiving well including an inner wall projecting downwardly from said top wall of the main body portion, a seat portion projecting inwardly from said inner wall and a rim projecting downwardly from the seat portion, said seat portion being recessed below the upper surface of said top wall a distance which corresponds substantially to the thickness of said lid so that, when said lid is properly seated in said receiving well in a closed position, the outer surface of said lid lies substantially flush with the upper surface of said top wall, at least one of the side walls of said main body portion including a base having a central portion and edge portions which mutually diverge from said central portion to increase the stability of the container case when the container case rests on said base.

2. A container case as defined in claim 1 wherein said main body portion is formed of single-walled construction.

3. A container case as defined in claim 1 wherein said lid is formed of double-walled construction and includes an inner wall and an outer wall.

4. A container case as defined in claim 4 wherein a recessed well is formed in said inner wall of said lid, said recessed well including a bottom portion which abutts said outer wall of said lid.

5. A container case as defined in claim 1 which further comprises means for locking said lid to said main body portion in a closed position.

6. A container case as defined in claim 1 wherein said lid locking means includes cooperating first and second protrusions formed on corresponding surfaces of said lid and said inner wall of said lid receiving well respectively, said first protrusion contacting and passing said second protrusion when said lid is opened and closed.

7. A container case as defined in claim 1 wherein at least one side wall of said main body portion includes a stepped portion.

8. A container case as defined in claim 1 wherein said main body portion further includes means for opening said lid when said lid is in the closed position.

9. A container case as defined in claim 8 wherein said lid opening means includes a recess which is formed in said top wall of said main body portion and which extends downwardly therefrom a distance sufficient to expose a side edge of said lid.

10. A container case as defined in claim 1 wherein said lid mounting means includes a pair of pin posts which project outwardly from opposite side of said lid, said pin posts being positioned in proximity to adjacent corners of said lid and received by cooperating openings formed in corresponding portions of said inner wall of said lid receiving well, said openings acting to retain said lid to said main body portion and allowing said lid to pivot about a lid edge axis between an open and a closed position.

11. A container case as defined in claim 10 wherein the pivotal edge of said lid is rounded to allow said lid to be opened and closed without interferring with said lid receiving well.

12. A container case as defined in claim 1 wherein said main body portion further includes a plurality of support legs formed on the bottom wall thereof, each of said support legs being spaced inwardly from a corresponding corner of said main body portion.

13. A container case as defined in claim 1 wherein said main body portion includes a handle formed integrally with a side wall thereof, said handle being defined by upper and lower recesses formed in said top and bottom walls respectively and portions of said front wall, said recesses being positioned centrally between opposite side walls of said main body portion.

* * * * *